US009436117B2

(12) United States Patent
Kikuchi et al.

(10) Patent No.: US 9,436,117 B2
(45) Date of Patent: Sep. 6, 2016

(54) IMAGE FORMING APPARATUS CONFIGURED TO MODIFY A REFERENCE VOLTAGE CORRECTION AMOUNT

(71) Applicants: Hisashi Kikuchi, Kanagawa (JP); Kazuhiko Watanabe, Tokyo (JP); Takaaki Tawada, Kanagawa (JP); Eisuke Shimizu, Tokyo (JP)

(72) Inventors: Hisashi Kikuchi, Kanagawa (JP); Kazuhiko Watanabe, Tokyo (JP); Takaaki Tawada, Kanagawa (JP); Eisuke Shimizu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/856,996

(22) Filed: Sep. 17, 2015

(65) Prior Publication Data

US 2016/0097987 A1 Apr. 7, 2016

(30) Foreign Application Priority Data

Oct. 2, 2014 (JP) ..... 2014-203636

(51) Int. Cl.
*G03G 15/02* (2006.01)
*G03G 15/00* (2006.01)

(52) U.S. Cl.
CPC ..... *G03G 15/0266* (2013.01); *G03G 15/80* (2013.01)

(58) Field of Classification Search
CPC ..... G03G 15/0266; G03G 15/80
USPC ..... 399/50
See application file for complete search history.

(56) References Cited

U.S. PATENT DOCUMENTS 5,701,551 A * 12/1997 Honda ..... G03G 15/0266 399/50
5,805,954 A * 9/1998 Takahashi ..... G03G 15/0266 399/50
2008/0226317 A1* 9/2008 Nakazawa ..... G03G 15/0266 399/50

FOREIGN PATENT DOCUMENTS

| | | |
|---|---|---|
| JP | 8-101565 | 4/1996 |
| JP | 8-152767 | 6/1996 |
| JP | 9-185220 | 7/1997 |
| JP | 9-265215 | 10/1997 |
| JP | 2000-338749 | 12/2000 |
| JP | 2001-125322 | 5/2001 |

* cited by examiner

*Primary Examiner* — Sophia S Chen
(74) *Attorney, Agent, or Firm* — Harness, Dickey & Pierce, P.L.C.

(57) ABSTRACT

An image forming apparatus, includes an image carrier; a power supply; a charging member, to which the power supply applies a direct current (DC) charging voltage, to charge a surface of the image carrier; and a controller. The controller causes the power supply to apply, to the charging member, the DC charging voltage of a sum of a reference voltage VC and a correction amount α, so that a charged potential VD of the surface of the image carrier assumes a target value that is substantially equal to the reference voltage VC; and to increase an absolute value of the correction amount α to be added to the reference voltage VC in inverse proportion to an absolute value of the reference voltage VC, when the absolute value of the reference voltage VC is smaller compared to a case in which the absolute value of the reference voltage VC is greater.

8 Claims, 3 Drawing Sheets

IMAGE FORMING APPARATUS CONFIGURED TO MODIFY A REFERENCE VOLTAGE CORRECTION AMOUNT

CROSS-REFERENCE TO RELATED APPLICATION

The present application claims priority pursuant to 35 U.S.C. §119(a) from Japanese patent application number 2014-203636, filed on Oct. 2, 2015, the entire disclosure of which is incorporated by reference herein.

BACKGROUND

1. Technical Field

The present invention relates to an image forming apparatus such as a copier, a printer, a facsimile machine, or a multi-function apparatus having one or more capabilities of the above devices, and in particular, to an image forming apparatus that can properly correct charging voltage to be applied to a charging member such as a charging roller.

2. Background Art

In an electrophotographic image forming apparatus, such as a copier and a printer, it is necessary to adjust the charging voltage to be applied to the charging member in order to reliably form a quality image even though performance of the image carrier, such as a photoconductor drum, or the charging member, such as a charging roller, has been degraded over time or due to environmental changes.

Several approaches have been tried. For example, the current/voltage when the rated voltage or current is applied to the charging roller is measured, and the resistance of the charging roller is obtained from the results. From a relation between the obtained resistance and the temperature detected by a temperature sensor, variation of the charged potential is forecasted and the charging voltage to be applied to the charging roller is corrected as needed. Alternatively, the temperature of the charging roller is detected and the charging voltage to be applied to the charging roller is corrected based on the detection results. Further alternatively, a surface potentiometer is used to detect the surface potential (charged potential or the exposure potential) of the photoconductor drum and image forming conditions, such as charging voltage to be applied to the charging member, are adjusted based on the surface potential of the photoconductor drum detected by the surface potentiometer.

SUMMARY

In one embodiment of the disclosure, there is provided an optimal image forming apparatus including an image carrier; a power supply; a charging member, to which the power supply applies a direct current (DC) charging voltage, to charge a surface of the image carrier; and a controller. The controller causes the power supply to apply, to the charging member, the DC charging voltage of a sum of a reference voltage VC and a correction amount $\alpha$, so that a charged potential VD of the surface of the image carrier assumes a target value that is substantially equal to the reference voltage VC; and to increase an absolute value of the correction amount $\alpha$ to be added to the reference voltage VC in inverse proportion to an absolute value of the reference voltage VC, when the absolute value of the reference voltage VC is smaller compared to a case in which the absolute value of the reference voltage VC is greater.

These and other objects, features, and advantages of the present invention will become apparent upon consideration of the following description of the preferred embodiments of the present invention when taken in conjunction with the accompanying drawings.

DETAILED DESCRIPTION

Figure 1:
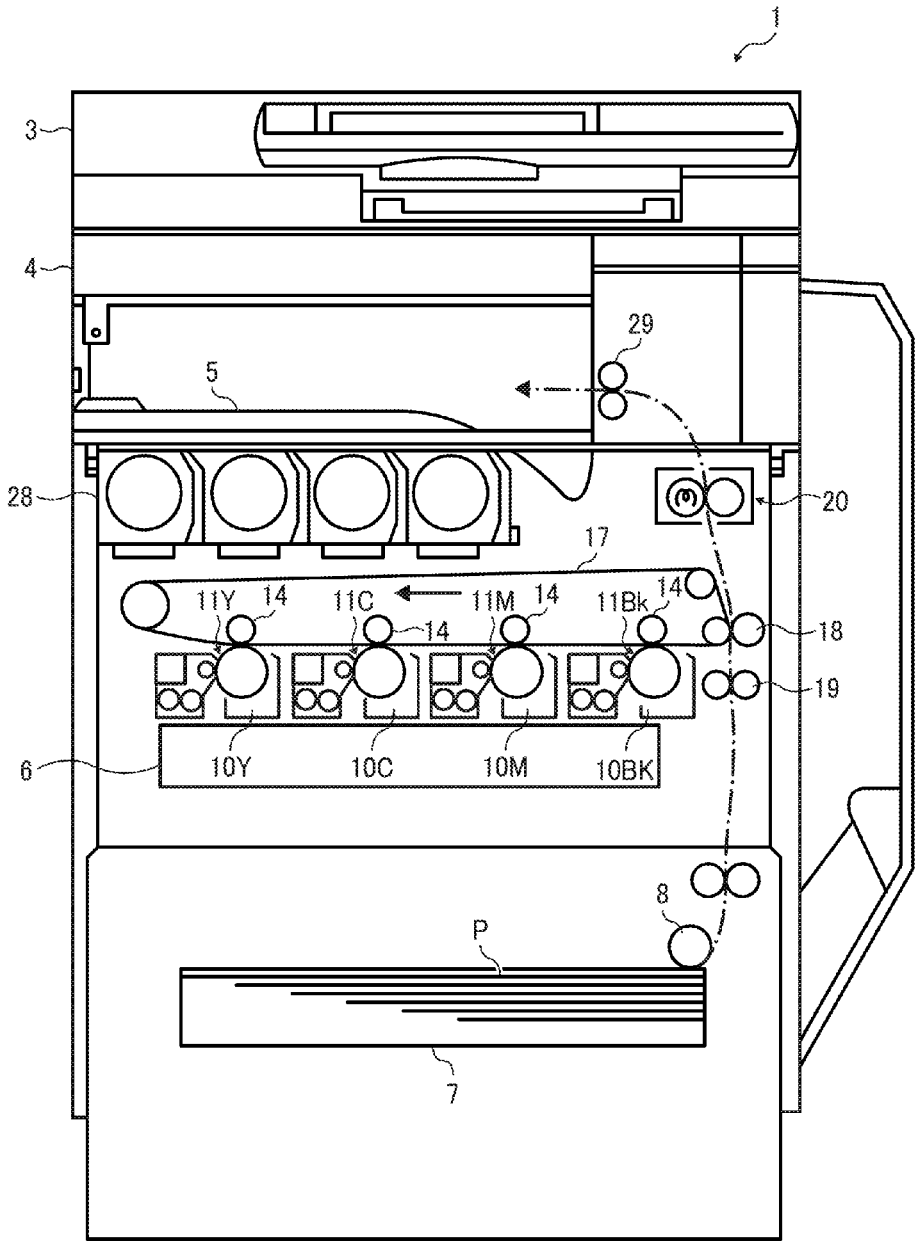
FIG. 1 is a schematic view of an image forming apparatus according to an embodiment of the present invention.

Hereinafter, preferred embodiments of the present invention will be described with reference to accompanying drawings. In each figure, the same or corresponding part is given the same reference numeral and a redundant explanation thereof is omitted or simplified appropriately.

First, as illustrated in FIG. 1, an overall structure and operation of an image forming apparatus will be described.

As illustrated in FIG. 1, the image forming apparatus 1 is a tandem-type color copier and includes: a document feeder 3 to feed a document to a document reader 4, the document reader 4 reading image data of the document; an exposure device (or a writing section) 6 to emit exposure light L (that is, laser beams) based on input image data; sheet trays 7 in which recording media P such as transfer sheets are stacked; process cartridges 10Y, 10M, 10C, and 10BK corresponding to each color of yellow, magenta, cyan, and black; a primary transfer roller 14 to transfer a toner image formed on each photoconductor drum or image carrier to an intermediate transfer belt 17, an intermediate transfer body; a secondary transfer roller 18 to transfer the toner image formed on the intermediate transfer belt 17 to a recording medium P; a fixing device 20 to fix the unfixed image on the recording medium P onto the recording medium P; and toner containers 28 to supply each color of toner to a developing device of the process cartridges 10Y, 10M, 10C, and 10BK.

Figure 2:
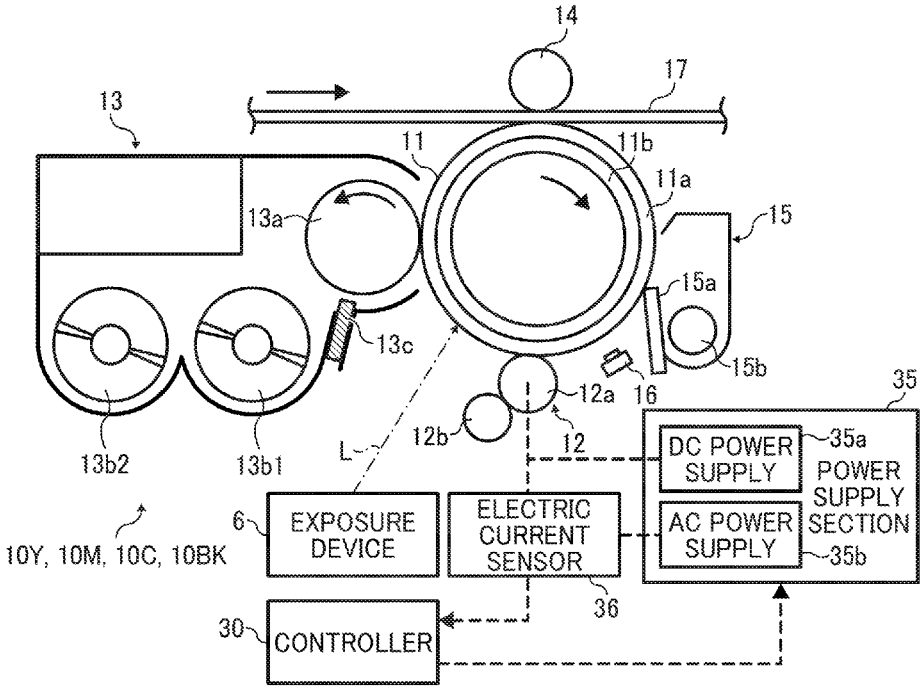
FIG. 2 is a structural view of an image forming section of the image forming apparatus.

Herein, each of the process cartridges 10Y, 10M, 10C, and 10BK includes the photoconductor drum 11, a charging device 12, a developing device 13, and a cleaning device 15, in an integrated manner (see FIG. 2). Each of the process cartridges 10Y, 10M, 10C, and 10BK is detachably attached to the apparatus body and is removed from the apparatus body when lifetime thereof comes to an end.

Specifically, a toner image of each color (yellow, magenta, cyan, or black) is formed on each photoconductor drum 11 included in each of the process cartridges 10Y, 10M, 10C, and 10BK.

Hereinafter, a color image forming operation of the image forming apparatus 1 will be described.

First, a document is conveyed via conveyance rollers of the document feeder 3 from an original platen and is placed on a contact glass of the document reader 4. Then, the document reader 4 optically reads out image information of the document placed on the contact glass.

More specifically, the document reader 4 causes an illumination lamp to emit light onto the image of the document on the contact glass for scanning. Then, the light reflected by the document is focused onto a color sensor via various mirrors and lenses. The color image information of the document is read by the color sensor for the light of each separated color of RGB (red, green, and blue) and is converted to electrical image signals. Further, based on the RGB separated-color image signals, an image processor performs color conversion process, color correction process, spatial frequency correction process, and the like, and obtains color image information of yellow, magenta, cyan, and black.

Then, image information of each color of yellow, magenta, cyan, and black is sent to the exposure device 6. The exposure device 6 emits the exposure light L or laser beams based on each piece of color image information toward the photoconductor drum 11Y, 11M, 11C, or 11BK of the corresponding process cartridge 10Y, 10M, 10C, or 10BK.

On the other hand, the four photoconductor drums 11Y, 11M, 11C, and 11BK each rotate in the clockwise direction as illustrated in FIG. 1. The surface of each of the photoconductor drums 11Y, 11M, 11C, and 11BK is uniformly charged at a position opposite the charging roller 12*a*. This is a charging process. Thus, a charged potential VD, that is, a potential of the non-image portion, is formed on each of the photoconductor drums 11Y, 11M, 11C, and 11BK. Thereafter, the charged surface of the photoconductor drums 11Y, 11M, 11C, and 11BK reaches a position at which the exposure light corresponding to each color is emitted.

In the exposure device 6, the exposure light L corresponding to the image signals of each color is emitted from light sources. The exposure light enters into a polygon mirror, and is reflected therefrom, and transmits plural lenses. Each exposure light that has passed through the plural lenses, passes through a different light path for each image component of yellow, magenta, cyan, and black. This is an exposure process.

The exposure light corresponding to the yellow component is irradiated to a surface of the photoconductor drum 11Y disposed leftmost in FIG. 1. At this time, the exposure light of the yellow component is scanned in a rotary axis direction of the photoconductor drum 11Y, (that is, in a main scanning direction) by the polygon mirror rotating at a high speed. Thus, on the surface of the photoconductor 11Y charged by the charging roller 12*a*, an electrostatic latent image corresponding to the yellow component is formed. Specifically, an exposed potential VL, that is, a potential of the image portion, is formed on the portion irradiated by the exposure tight.

Similarly, the exposure light corresponding to the cyan component is irradiated to the surface of the photoconductor drum 11 of the process cartridge 10C disposed at a second position from left in FIG. 1, and an electrostatic latent image corresponding to the cyan component is formed on the photoconductor drum 11C. The exposure light corresponding to the magenta component is irradiated to the surface of the photoconductor drum 11M of the process cartridge 10M disposed at a third position from left in FIG. 1, and an electrostatic latent image corresponding to the magenta component is formed on the photoconductor drum 11M. The exposure light corresponding to the black component is irradiated to the surface of the photoconductor drum 11BK disposed at a fourth position from left in FIG. 1, and an electrostatic latent image corresponding to the black component is formed on the photoconductor drum 11BK.

Thereafter, the surfaces of the photoconductor drums 11Y, 11M, 11C, and 11BK each on which an electrostatic latent image corresponding to each color is firmed reach a position opposite the developing device 13. Then, toner of each color is supplied from each developing device 13 to each surface of the photoconductor drums 11Y, 11M, 11C, and 11BK and each latent image on the photoconductor drums 11Y, 11M, 11C, and 11BK is developed. This is a developing process.

Thereafter, each surface of the photoconductor drums 11Y, 11M, 11C, and 11BK after the developing process reaches a position opposite the intermediate transfer belt 17. Herein, the primary transfer roller 14 is so disposed as to contact an inner surface of the intermediate transfer belt 17 at each opposite position between the photoconductor drums 11Y, 11M, 11C, and 11BK and the intermediate transfer belt 17. Then, at a position of the primary transfer roller 14, each toner image formed on the photoconductor drums 11Y, 11M, 11C, and 11BK is sequentially transferred onto the intermediate transfer belt 17 in the superimposed manner. This is a primary transfer process.

Each surface of the photoconductor drums 11Y, 11M, 11C, and 11BK after the primary transfer process reaches a position opposite the cleaning device 15. The cleaning device 15 collects untransferred toner remaining on the photoconductor drums 11Y, 11M, 11C, and 11BK. This is a cleaning process.

Each surface of the photoconductor drum 11 reaches a position of a discharging lamp 16 that emits discharging light, so that the surface of the photoconductor drum 11 is discharged to substantially zero volt.

Thus, a series of image forming processes in the photoconductor drum 11 is complete.

On the other hand, the intermediate transfer belt 17 onto which toner images of respective colors on the photoconductor drums 11Y, 11M, 11C, and 11BK are transferred in the superimposed manner rotates in the clockwise direction as illustrated in FIG. 1 and reaches a position opposite the secondary transfer roller 18. Then, at a position opposite the secondary transfer roller 18, a full-color toner image carried on the intermediate transfer belt 17 is transferred onto the recording medium P. This is a secondary transfer process.

Then, the intermediate transfer belt 17 is rotated further and reaches the intermediate transfer belt cleaner. Untransferred toner on the intermediate transfer belt 17 is collected by the intermediate transfer belt cleaner, and a series of transfer processes related to the intermediate transfer belt 17 is complete.

Herein, the recording medium P conveyed to the position of the secondary transfer roller 18 has been conveyed from a sheet tray 7 via a conveyance guide, a registration roller pair 19, and the like.

Specifically, the recording medium P that has been conveyed from the sheet feed tray 7 containing the recording medium P by a sheet feed roller 8, passes through the conveyance guide, and is guided to the registration roller pair 19 that serves as timing rollers. The recording sheet P that has reached the registration roller pair 19 is conveyed to the secondary transfer roller 18 in synch with the appearance of a toner image on the intermediate transfer belt 17.

Then, the recording medium P on which a full-color toner image has been transferred is guided to the fixing device 20 including a fixing roller and a pressure roller. The fixing device 20 fixes the color image onto the recording medium P at a nip portion formed between the fixing roller and the pressure roller.

Then, the recording medium P after the fixing process, is discharged as an output image to outside the apparatus body by an ejection roller pair 29, and is stacked on a sheet ejection tray 5. Thus, a series of image forming operation is complete.

Next, as illustrated in FIG. 2, an overall structure and operation of the image forming section of the image forming apparatus will be described.

FIG. 2 schematically illustrates one exemplary process cartridge 10 and peripheral parts thereof. Each of the process cartridges 10Y, 10M, 10C, and 10BK is substantially similarly constructed excluding that the color of the toner used in the image forming processes is different.

As illustrated in FIG. 2, each of the process cartridges 10Y, 10M, 10C, and 10BK includes a photoconductor drum 11, a charging device 12 to electrically charge a surface of the photoconductor drum 11, a developing device 13 to develop an electrostatic latent image formed on the photoconductor drum 11 to render it a visible toner image, and a cleaning device 15 to collect untransferred toner remaining on the photoconductor drum 11, each of which is accommodated integrally in a case.

Herein, the photoconductor drum 11 as an image carrier is an organic, negatively charged photoconductor, and includes a drum-shaped conductive support body, and a photoconductive layer formed on the support body.

More specifically, the photoconductive layer formed on the conductive support body serving as a base layer, includes a charge generation layer 11*b* and a charge transport layer 11*a*, both of which are sequentially laminated one after another. The lamination structure of the photoconductor drum 11 is not limited to the above, and may include an undercoat layer as an insulation layer formed between the conductive support body or the base layer and the photoconductive layer.

The structure of each layer of the photoconductor drum 11 will be described in greater detail.

The charging device 12 includes a charging roller 12*a* as a charging member, and a cleaning roller 12*b*.

The charging roller 12*a* includes a conductive metal core, and an elastic layer with medium resistance coated on an outer circumference of the metal core. A roller portion of the charging roller 12*a* contacts the photoconductor drum 11 across a longitudinal width of the photoconductor drum 11 and the charging roller 12*a* is driven to rotate according to a rotation of the photoconductor drum 11. Preferred surface roughness Rz of the charging roller 12*a* ranges from 10 to 20 μm, and is designed to be around 15 μm according to the present embodiment. If the surface roughness Rz is less than 10 μm and concavity and convexity of the surface of the charging roller 12*a* reduces, electrical charge tends to flow along the roller surface, thereby causing horizontal lines to be generated in the formed image. In addition, when the surface roughness Rz exceeds 20 μm and concavity and convexity of the surface of the charging roller 12*a* increases, fluctuations in the concavity and convexity cause density fluctuation in the formed image when forming a halftone image.

The conductive layer of the charging roller 12*a* includes two-layer structure formed of a base layer and a surface layer. The surface layer includes dispersed particles having a particle diameter of approx. 15 μm, which form the shape of concavity and convexity. Without using such particles, the concave and convex surface extending along a circumferential direction of the surface of the conductive layer can be generated randomly by frictioning with sand paper while rotating the charging roller. Such concavity and convexity formed on the roller surface decreases a contact area relative to the photoconductor drum 11, thereby properly distributing a contact portion and a gap portion. As a result, opportunities of discharging increase and charging is stabilized. In particular, when the process linear speed is higher, such a charging stabilizing effect is greater. In addition, because the contact area of the roller surface of the charging roller 12*a* relative to the photoconductor drum 11 decreases, contamination of the photoconductor drum 11 due to the charging roller 12*a* and of the charging roller 12*a* due to the toner on the photoconductor drum 11 decreases.

The cleaning roller 12*b* in the charging device 12 serves to eliminate contamination on the surface of the charging roller 12*a*, and is so disposed as to contact the charging roller 12*a*.

The cleaning roller 12*b* may include a metal core, and a sponge layer formed of polyurethane or melamine resins disposed on the metal core. Alternatively, the cleaning roller 12*b* may include a metal core, and a conductive or insulative nylon, acrylic, or polyester fibers wound around the metal core. In the embodiment of the present invention, the cleaning roller 12*b* is configured to rotate according to a rotation of the charging roller 12*a*.

In the thus-configured charging device 12, a superimposed charging bias in which an alternate current voltage is superimposed on a direct current voltage is applied to the charging roller 12*a* as a charging member from a power supply section 35, so that the surface of the photoconductor drum 11 contacting the charging roller 12*a* is uniformly charged. More specifically, the power supply section 35 includes a DC power supply 35*a* and an AC power supply 35*b*, the DC power supply 35*a* applies the DC charging voltage to the metal core of the charging roller 12*a*, and the AC power supply 35*b* applies the AC charging voltage to the metal core of the charging roller 12*a*. Because the superimposed voltage in which the AC voltage is superimposed on the DC voltage is applied to the charging roller 12*a* in the charging process, the charged potential VD formed on the surface of the photoconductor drum 11 is more uniform compared to a case in which the DC voltage alone is applied to the charging roller 12*a* in the charging process. Furthermore, the density fluctuation is less in the halftone image, horizontal lines due to charging failure do not tend to occur, and a quality image can be formed.

Further, in the present embodiment, a controller 30 controls the DC power supply 35*a* of the power supply section 35, to thereby adjust amount of the charging bias to be applied to the charging roller 12*a*, of which configuration will be described later.

The developing device 13 mainly includes a developing roller 13*a*, a first conveyance screw 13*b*1, a second conveyance screw 13*b*2, and a doctor blade 13*c*. The developing roller 13*a* is disposed opposite the photoconductor drum 11. The first conveyance screw 13*b*1 is disposed opposite the developing roller 13*a*. The second conveyance screw 13*b*2 is disposed opposite the first conveyance screw 13*b*1 with a sectioning member in between, and the doctor blade 13*c* is disposed opposite the developing roller 13*a*. The developing roller 13*a* includes a magnet and a sleeve rotating around the magnet. The magnet is fixed inside the developing roller 13*a* and forms a magnetic pole on the peripheral surface of the developing roller 13*a*. Because a plurality of magnetic poles is formed on the developing roller 13*a* due to the magnet, a developer or a developing agent is carried on the developing roller 13*a*.

The developer includes carriers and toner, which is called two-component developer and is contained in the developing device 13. In the present embodiment, toner charged with a negative polarity is used.

The cleaning device 15 includes a cleaning blade 15*a* contacting the photoconductor drum 11 and a conveyance coil 15*b* that conveys the waste toner collected in the cleaning device 15 toward a waste toner container. The cleaning blade 15*a* is formed of a rubber material such as a urethane rubber, and contacts the surface of the photoconductor drum 11 with predetermined angle and pressure. With this structure, adhered materials such as untransferred toner deposited on the photoconductor drum 11 are mechanically scraped off by the cleaning blade 15*a* and collected inside the cleaning device 15. Herein, the adhered materials deposited on the photoconductor drum 11 include, other than the untransferred toner, paper dust generated from the recording medium P or sheet, corona products generated on the photoconductor drum 11 when the charging roller 12*a* electrically charges, additives added to the toner, and the like.

Image forming processes are now described in greater detail with reference to FIG. 2.

The developing roller 13*a* rotates in a direction indicated by an arrow in FIG. 2, i.e., in the counterclockwise direction. The developer inside the developing device 13 circulates in a longitudinal direction (i.e., in a perpendicular direction relative to a surface of the figure), while being agitated and mixed by a rotation of the first conveyance screw 13*b*1 and the second conveyance screw 13*b*2 disposed with a sectioning member in between, together with the toner replenished from the toner container 28 via the toner supply section.

The toner adhered to the carriers due to triboelectric charging, is carried on the developing roller 13*a* with the carriers. The developer carried on the developing roller 13*a* thereafter reaches a position of the doctor blade 13*c*. The developer carried on the developing roller 13*a* is adjusted to an appropriate amount at a position of the doctor blade 13*c*, and reaches a position opposite the photoconductor drum 11, that is a developing area.

The toner included in the developer adheres to the electrostatic latent image formed on the surface of the photoconductor drum 11 in the developing area. Specifically, the toner adheres to the latent image due to an electric field formed by the potential difference between the latent image potential (i.e., potential of the exposed area) of the image to which the exposure light IL or the laser beams are irradiated, and the developing bias that the developing roller 13*a* applies. The toner image is thus formed.

Thereafter, almost all the toner adhered to the photoconductor drum 11 in the developing process, is transferred onto the intermediate transfer belt 17. Then, the cleaning blade 15*a* collects untransferred toner remaining on the photoconductor drums 11Y, 11M, 11C, and 11BK, into the cleaning device 15.

The toner replenisher disposed on the apparatus body includes a replaceable bottle-shaped toner container 28 and a toner hopper to hold and drive the toner container and replenish fresh toner to the developing device 13. Each toner container 28 contains fresh toner (of either yellow, magenta, cyan, or black). Helical shaped projections are formed on an interior surface of the toner bottle or the toner container 28.

The fresh toner inside the toner container 28 is properly replenished into the developing device 13 through a toner supply port when the toner inside the developing device 13 has been consumed. Although not shown in the figure, whether the toner inside the developing device 13 has been consumed or not is detected by a magnetic sensor disposed below the second conveyance screw 13*b*2 of the developing device 13.

Hereinafter, a structure of each layer of the photoconductor drum 11 according to the present embodiment will be described.

As described above, the photoconductor drum 11 according to the present embodiment includes a conductive support body as a base layer, and a photoconductive layer formed on the support body and including the charge generation layer 11*b* and the charge transport layer 11*a* or the surface layer, both of which are laminated one after another. The charge transport layer 11*a* is formed as a surface layer disposed on top of the layers in the photoconductor drum 11.

Preferred materials for the conductive support body show conductivity with volume resistance of $10^{10}$ Ω*cm or less and includes, for example, metals such as aluminum, nickel, chrome, nichrome, copper, gold, silver, and platinum; and metal oxides such as tin oxide, and indium oxide, which are coated on a film-like or cylinder plastic or paper by vapor deposition or sputtering. Alternatively, a base pipe made from aluminum, aluminum alloy, nickel, or stainless steel sheet by processes such as extrusion or drawing, and subjected to a surface treatment such as cutting, super finishing, and polishing, may be used.

The charge generation layer 11*b* is a layer mainly including charge generation materials. Preferred materials for the charge generation layer 11*b* include known charge generation materials, and representative examples thereof include monoazo pigment, disazo pigment, trisazo pigment, perylene-based pigment, perynone-based pigment, quinacridone-based pigment, quinine-based condensed polycyclic compound, and squaric acid dyes. Alternatively, phthalocyanine pigment, naphthalocyanine pigment, and azulenium salt pigment, and the like, may be included and used.

The above charge generation materials may be used alone or two kinds or more may be mixed and used in combination.

The charge generation layer 11*b* may be prepared by coating a coating liquid on the conductive support body and drying the coated liquid. The coating liquid is prepared by dispersing a charge generation material in an appropriate solvent with a binder resin as appropriate, using a ball mill, attritor, sand mill or ultrasonic dispersion machine.

Examples of binder resins used for the charge generation layer 11*b* if needed include polyamide, polyurethane, epoxy resin, polyketone, polycarbonate, silicon resin, acrylic resin, polyvinyl butyral, polyvinyl formal, polyvinyl ketone, and the like. In addition, polystyrene, polysulfone, poly-N-vinylcarbazole, polyacrylamide, polyvinylbenzal, polyester, phenoxy resin, chlorovinyl-vinyl acetate copolymer, polyvinyl acetate, polyphenylene oxide, polyamide, and the like, may be preferably used. In addition, polyvinyl pyridine, cellulose resin, casein, polyvinyl alcohol, polyvinyl pyrolidone may also be preferably used.

The content of the binder resins is preferably from 0 to 500 parts by weight per 100 parts by weight of the charge generation material, and more preferably from 10 to 300 parts by weight.

Specific examples of solvents used for preparing the charge generation layer 11*b* include isopropanol, acetone, methyl ethyl ketone, cyclohexanone, tetrahydrofuran, dioxane, ethyl cellosolve, ethyl acetate, methyl acetate, and the like. Dichloromethane, dichloroethane, monochlorobenzene, cyclohexane, toluene, xylene, ligroin, and the like are also preferably used. In particular, ketone-based solvent, ester-based solvent, and ether-based solvent can be preferably used.

Exemplary coating methods of coating liquid includes dip coating, spray coating, beat coating, nozzle coating, spinner coating, and ring coating.

The thickness of the charge generation layer 11*b* is preferably from 0.01 to 5 μm, and more preferably from 0.1 to 2 μm.

The charge transport layer 11*a* is formed by dissolving or dispersing the charge transport material and the binder resin in a predetermined solvent, and coating and drying the dispersed solvent on the charge generation layer 11*b*. If required, a plasticizer, leveling agent, and oxidation inhibitor can be added.

Herein, the charge transport material includes a hole transport material and an electron transport material.

Examples of charge transport materials include electron accepting materials such as, for example, chloranil, bromanil, tetracyanoethylene, tetracyanoquinodimethane, 2,4,7-trinitro-9-fluorenone, 2,4,5,7-tetranitro-9-fluorenone. In addition, the electron accepting materials such as 2,4,5,7-tetranitroxanthone, 2,4,8-trinitrothioxanthone, 2,6,8-trinitro-4H-indeno(1,2-b)thiophene-4-one are also used. The electron accepting materials further include 1,3,7-trinitrodibenzothiophene-5,5-dioxide, and derivatives of benzoquinone.

Examples of the hole transport materials include poly-N-vinylcarbazole and derivatives thereof, poly-γ-carbazolylethylglutamate and derivatives thereof, pyrene-formaldehyde condensation products and derivatives thereof, polyvinylpyrene, polyvinylphenanthrene, and the like. Examples of the hole transport materials further include polysilane, oxazole derivatives, oxadiazole derivatives, imidazole derivatives, monoallylamine derivatives, diallylamine derivatives, triallylamine derivatives, stilbene derivatives, α-phenylstilbene derivatives. Further, benzidine derivatives, diallylmethane derivatives, triallylmethane derivatives, 9-styrylanthracene derivatives, pyrazoline derivatives, divinylbenzene derivatives, hydrazone derivatives, indene derivatives, butadiene derivatives, and pyrene derivatives may be preferably used. Furthermore, bisstilbene derivatives, enamine derivatives, and other known materials may be preferably used.

These charge transport materials may be used alone or two or more kinds mixed in combination are also used.

Examples of binder resins may include thermoplastic or thermocurable resins such as polystyrene, styrene-acrylonitril copolymer, styrene-budadiene copolymer, styrene-maleic anhydride copolymer, polyester, polyvinylchloride, vinylchloride-vinylacetate copolymer. In addition, thermoplasic or thermocurable resins such as polyvinyl acetate, polyvinylidene chloride, polyarylate, phenoxy resin, polycarbonate, acetylcellulose resin, ethylcellulose resin, polyvinyl butyral, polyvinyl formal, polyvinyl toluene may also be used. Further, thermoplastic or thermocurable resins such as poly-N-vinylcarbazole, acrylic resin, silicon resin, epoxy resin, melamine resin, urethane resin, phenol resin, and alkyd resin may also be used.

The content of the charge transport material relative to 100 parts by weight of the binder resin is preferably from 20 to 300 parts by weight, and more preferably from 40 to 150 parts by weight.

Herein, specific examples of solvents used in preparing the charge transport layer 11*a* include tetrahydrofuran, dioxane, toluene, dichloromethane, monochlorobenzene, dichloroethane, cyclohexanone, methyl ethyl ketone, acetone, and the like.

In the present embodiment, the charge transport layer 11*a* of the photoconductor drum 11 further includes a plasticizer or leveling agent. Examples of plasticizers used in forming the charge transport layer 11*a* include dibutyl phthalate, dioxyle phthalate, and the like, that are used as a common resinous plasticizer, and the preferable content thereof relative to the binder resin ranges from 0 to 30% by weight.

Examples of leveling agents include silicone oils such as dimethyl silicone oil and methyphenyl silicone oil, and polymers having perfluoroalkyl group in the side chain, or oligomers. Preferable content thereof relative to the binder resin is from 0 to 1% by weight.

In the present embodiment, an undercoat layer can be disposed between the conductive support body and the photoconductive layer (or the charge generation layer 11*b*).

The undercoat layer mainly includes resins, and the resin for the undercoat layer preferably includes a higher anti-solvent property against a general organic solvent because the photoconductive layer is coated with the solvent.

Examples of resins for the undercoat layer include water-soluble resins such as polyvinyl alcohol, casein, and sodium polyacrylate, or alcohol-soluble resins such as nylon copolymer, methoxymetylated nylon, and the like. In addition, curable resins forming three-dimensional network structure such as polyurethane, melamine resin, phenol resin, alkyd-melamine resin, expoxy resin, and the like may be preferably used.

Further, the undercoat layer may include fine particle pigments of metal oxide products such as titanium oxide, silica, alumina, zirconium oxide, tin oxide, indium oxide, and the like, so that moire can be prevented and the residual potential can be decreased.

The undercoat layer can be formed using a predetermined solvent and coating method similarly to the photoconductive layer.

Further, as the undercoat layer, the silane coupling agent, titan coupling agent, chrome coupling agent, and the like, can be used. Furthermore, as the undercoat layer, anodized $Al_2O_3$, and organic materials such as polyparaxylylene (parylene) and inorganic materials such as $SiO_2$, $SnO_2$, $TiO_2$, $In_2O_3/SnO_2$ (ITO), $CeO_2$ subjected to vacuum thin film formation method may be optimally used. Other known materials may also be used.

A preferred thickness of the film of the undercoat layer is from 0 to 5 μm.

Herein, the photoconductor drum 11 is repeatedly used on a long-term basis, and consequently the charge transport layer in the surface layer is abraded over time. When the surface of the photoconductor drum 11 is charged by the charging roller 12*a*, ozone and NOx gas are generated and adhered on the surface of the photoconductor drum 11. Such adhered foreign matter causes image blurring. However, by abrading the surface of the drum, the image blurring can be prevented.

If the charge transport layer 11*a* is thin, allowance of the carrier adhesion is decreased, so that the initial thickness thereof is preferably set to 20 μm or more. Because the charge transport layer 11*a* is used while being abraded, as the initial thickness of the layer is greater, the lifetime of the photoconductor drum 11 against the abrasion can be longer. However, the greater thickness may adversely affect the γ-linearity and persistence of vision. Thus, the thickness of the charge transport layer 11*a* is preferably set to 40 μm or less.

Hereinafter, correction of charging voltage applied to the image forming apparatus 1 according to the present embodiment will be described.

As described referring to FIG. 2 heretofore, the image forming apparatus 1 according to the present embodiment includes the power supply section 35 including the DC power supply 35*a* that applies a DC charging voltage and the AC power supply 35*b* that applies an AC charging voltage, so that the surface of the photoconductor drum 11 (that is, the image carrier) is charged by the charging roller 12*a*.

Herein, in the present embodiment, the power supply section 35 or the DC power supply 35*a* is controlled to apply the DC charging voltage of reference voltage VC to which is added a correction amount α to the charging roller 12*a*, so that the charged potential VD of the surface of the photoconductor drum 11 assumes a target value that corresponds to the reference voltage VC.

More specifically, in the warming-up operation performed immediately after a power-on or recovery from a standby mode, sensors detect image forming conditions such as toner adhesion amount relative to the developing potential, and a target charged potential VD is determined based on the detection result. As a result, DC charging voltage to be applied to the charging roller 12*a* from the DC power supply 35*a* is adjusted so that the target charged potential VD is formed on the photoconductor drum 11.

In actuality, the DC charging voltage applied to the charging roller 12*a* from the DC power supply 35*a* and the charged potential VD formed on the photoconductor drum 11 are not consistent with each other. As a result, the reference voltage VC, which is almost equal to the target charged potential VD to which is added a correction amount α (that is, a correction voltage), is applied to the charging roller 12*a* from the DC power supply 35*a*.

The process to determine the target charged potential VD in the above warming-up operation and the like may be any known method.

Figure 3:
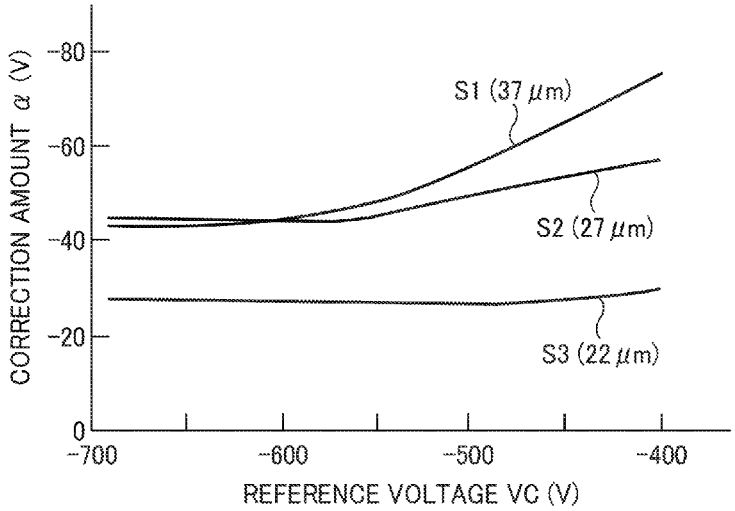
FIG. 3 is a graph showing a relation between a reference voltage and a correction amount of the DC charging voltage applied to a charging roller of the image forming section.

Referring now to FIG. 3, it is to be noted that, in the present embodiment, the power supply section 35 or the DC power supply 35*a* is controlled to increase an absolute value of the correction amount α to be added to the reference voltage VC when the absolute value of the reference voltage VC that corresponds to the charged potential VD is smaller compared to a case in which the absolute value of the reference voltage VC is greater.

Specifically, the correction amount α to be added to the reference voltage VC is not always constant but is determined based on the adjustment of the image forming conditions performed in the warming-up time, for example, and is variable depending on the size of the charged potential VD. More specifically, when the target charged potential VD is determined to be higher in the adjustment of the image forming conditions, the correction amount α is set to be smaller. By contrast, when the target charged potential VD is set to be lower, the correction amount α to be added to the reference voltage VC is set to be greater.

Further, in the present embodiment, the charge transport layer 11*a* of the photoconductor drum 11 includes an initial thickness of the layer set at 37 μm or so, and is controlled based on a relation between the reference voltage VC that equals to the target charged potential VD and the correction amount α as illustrated by a graph S1 in FIG. 3. Such control is performed because the difference between the DC charging voltage and the charged potential VD is not always constant, and that the difference tends to increase as the DC charging voltage decreases.

More specifically, the DC charging voltage to which is added a bias superimposed with AC charging voltage Vpp, which is more than double the charging start voltage, is applied to the charging roller 12*a*. A difference Δ between the DC charging voltage and the charged potential is not always constant, but changes due to charging conditions and effects from conditions of other parts and components. In particular, the difference Δ increases when electrical charge applied to the photoconductor drum 11 remains after the first transfer process by the primary transfer roller 14. In such a structure in which the primary transfer roller 14 is pressed against the photoconductor drum 11 via the intermediate transfer belt 17, a large electrical current flows from the primary transfer roller 14 to the photoconductor drum 11. Accordingly, when a constant correction amount α is added to the reference voltage VC and the absolute value of the actual charged potential VD decreases, the difference from the developing bias decreases, background contamination tends to occur, and an abnormal image such as white omission tends to occur. In addition, when a constant correction amount α is added to the reference voltage VC and the absolute value of the actual charged potential VD decreases, the difference from the developing bias increases, thereby causing carrier to adhere easily. When the charged potential deviates greatly from the target charged potential VD, the image density varies greatly.

In the present embodiment, because the target charged potential VD is generated on the photoconductor drum 11, the aforementioned defects can be reduced reliably.

In addition, effects of the control to vary the correction amount α corresponding to the size of the reference voltage VC is exerted more advantageously as the thickness of the charge transport layer 11*a* is greater. In particular, when the initial thickness of the charge transport layer 11*a* is 30 μm or greater, the effects of the above control are negligible.

FIG. 3 illustrates a graph S1 that shows an appropriate relation between the reference voltage VC and the correction amount α when the thickness of the charge transport layer 11*a* is 37 μm, a graph S2 that shows an appropriate relation between the reference voltage VC and the correction amount α when the thickness of the charge transport layer 11*a* is 27 μm, and a graph S3 that shows an appropriate relation between the reference voltage VC and the correction amount α when the thickness of the charge transport layer 11*a* is 22 μm. It is understood by comparing the graphs S1 to S3 in FIG. 3 that the correction amount α increases relative to the variation of the reference voltage VC, as the thickness of the charge transport layer 11*a* increases.

Thus, in the present embodiment, as the thickness of the charge transport layer 11*a* decreases over time, the power supply section 35 or the DC power supply 35*a* is controlled such that variation of the correction amount α relative to the variation of the reference voltage VC decreases.

As illustrated in FIG. 2, the image forming apparatus 1 includes an electric current sensor 36 serving as a sensor to detect the thickness of the charge transport layer 11*a* of the photoconductor drum 11. The electric current sensor 36 as a thickness sensor detects the charging electrical current flowing to the charging roller 12*a*, and obtains the thickness of the charge transport layer 11*a* based on the detected charging electrical current and the AC charging voltage applied from the power supply section 35 or the AC power supply 35*b*.

The power supply section 35 or the DC power supply 35*a* varies the correction amount α based on the detection result of the electric current sensor 36. Specifically, when the electric current sensor 36 detects that the thickness of the charge transport layer 11*a* is reduced, the power supply section 35 or the DC power supply 35*a* is controlled such that variation of the correction amount α relative to the variation of the reference voltage VC decreases.

More specifically, when the bias in which the AC charging voltage Vpp is superimposed on the DC charging voltage is applied to the charging roller 12*a*, the alternating current is high when applying the bias, and the photoconductor drum 11 suffers more damage. Thus, the current amount of the AC charging voltage Vpp is set within a range where no charging failure occurs. By contrast, the DC charging voltage is the target charged potential VD that equals to the reference voltage VC, and the correction amount α added thereto.

As FIG. 3 illustrates with the graph S1, when the thickness of the charge transport layer 11*a* is 37 μm and the surface of the photoconductor drum 11 is to be charged to −700 volts, the reference voltage VC is set to −700 volts and the correction amount α is set to −41 volts, so that the DC power supply 35*a* applies the DC charging voltage of −741 volts to the charging roller 12*a*. When the thickness of the charge transport layer 11*a* is 37 μm and the surface of the photoconductor drum 11 is to be charged to −500 volts, the reference voltage VC is set to −500 volts and the correction amount α is set to −56 volts, so that the DC power supply 35*a* applies the DC charging voltage of −556 volts to the charging roller 12*a*. In addition, when the thickness of the charge transport layer 11*a* is 37 μm and the surface of the photoconductor drum 11 is to be charged to −400 volts, the reference voltage VC is set to −400 volts and the correction amount α is set to −77 volts, so that the DC power supply 35*a* applies the DC charging voltage of −477 volts to the charging roller 12*a*. The correction amount α differs by 36 volts from when the reference voltage VC is −700 volts to when the reference voltage VC is −400 volts. When the thickness of the charge transport layer 11*a* is 37 μm, the correction amount α can be obtained by a following formula (1):

$$-\alpha=0.000415\times VC^2+0.5749\times VC+240.08 \quad (1)$$

In addition, when the charge transport layer 11*a* of the photoconductor drum 11 is abraded over time and the thickness reaches 27 μm, the correction amount α can be obtained by a following formula (2):

$$-\alpha=0.000255\times VC^2+0.3191\times VC+144.78 \quad (2)$$

In addition, when the thickness reaches 22 μm, the correction amount α can be obtained by a following formula (3):

$$-\alpha=0.000112\times VC^2+0.122\times VC+59.929 \quad (3)$$

In addition, when the thickness of the charge transport layer 11*a* is 27 μm and the surface of the photoconductor drum 11 is to be charged to −700 volts, the reference voltage VC is set to −700 volts and the correction amount α is set to −46 volts, so that the DC power supply 35*a* applies the DC charging voltage of −746 volts to the charging roller 12*a*. In addition, when the surface of the photoconductor drum 11 is to be charged to −400 volts, the reference voltage VC is set to −400 volts and the correction amount α is set to −58 volts, so that the DC power supply 35*a* applies the DC charging voltage of −458 volts to the charging roller 12*a*. The correction amount α differs by 12 volts from when the reference voltage VC is −700 volts to when the reference voltage VC is −400 volts. In such a case, even though the correction amount α is constant, the background contamination and the carrier adhesion do not tend to occur; however, because the correction amount α is slightly adjusted corresponding to the reference voltage VC, the variation of the image density can be suppressed with higher precision. When the thickness of the charge transport layer 11*a* is 30 μm or more and the correction amount α is constant, the background contamination and the carrier adhesion definitely tend to occur, so that varying the correction amount α in accordance with the reference voltage VC is particularly useful.

It is to be noted that the thickness of the charge transport layer 11*a* of the photoconductor drum 11 is detected by the electric current sensor 36 that detects the charging electrical current flowing in the charging roller 12*a*.

Figure 4A:
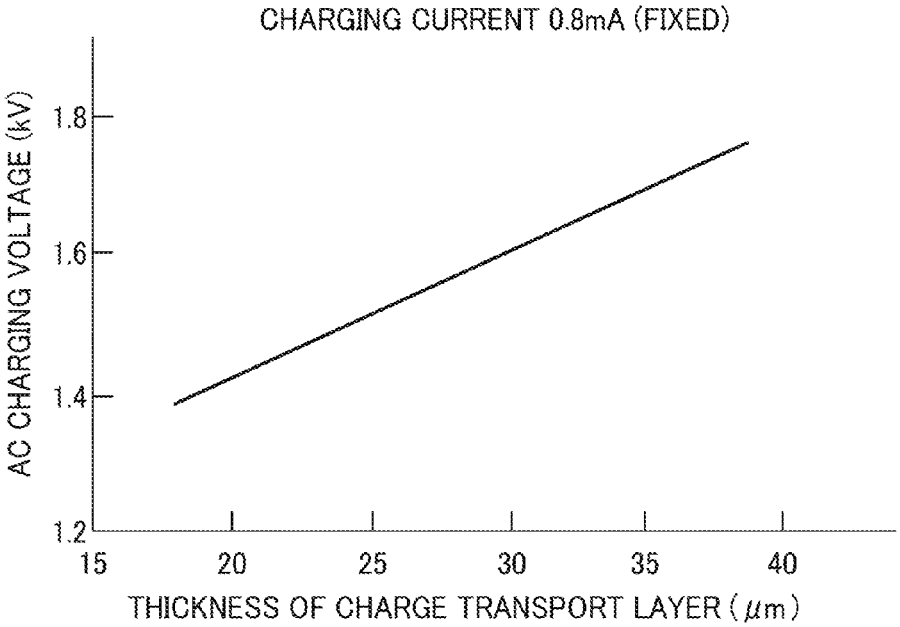
FIG. 4A is a graph showing a relation between a thickness of a charge transport layer of a photoconductor drum and AC charging current when the charging current amount is fixed.
Figure 4B:
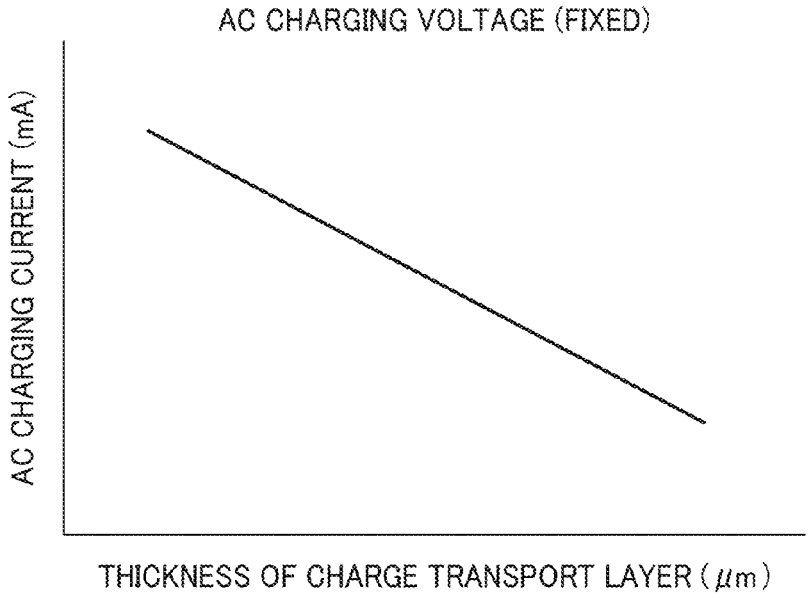
FIG. 4B is a graph showing a relation between a thickness of a charge transport layer of the photoconductor drum and AC charging current when the AC charging voltage amount is fixed.

The electric current sensor 36 can detect the thickness of the charge transport layer 11*a* because a relation between the AC charging voltage Vpp and the charging current depends on the thickness of the charge transport layer 11*a*. As a result, the thickness of the charge transport layer 11*a* of the photoconductor drum 11 over time can be assumed from the relation between the current and voltage detected when the charging roller 12*a* is given the voltage. FIG. 4A is a graph showing a relation between the AC charging voltage Vpp and the thickness of the charge transport layer 11*a* when the charging current is 0.8 mA. FIG. 4B is a graph showing a relation between the charging current and the thickness of the charge transport layer 11*a* when the AC charging voltage Vpp is fixed.

The controller 30 obtains a thickness of the charge transport layer 11*a* based on the AC charging voltage applied from the AC power supply 35*b* and the electrical current value detected by the electric current sensor 36. The controller 30 determines each correction amount α based on the obtained thickness using the formula (1) corresponding to the graph S1 when the thickness is 32 μm or more, for example. Similarly, the controller 30 determines each correction amount α using the formula (2) corresponding to the graph S2 when the thickness is from 25 to 32 μm, or alternatively, using the formula (3) corresponding to the graph S3 when the thickness is 25 μm or less. Otherwise, the number of formulae (sections) can be set more minutely so that the correction amount α can be determined correspondingly more precisely.

Further, optionally, the image forming apparatus 1 can employ a timer or counter to count an accumulated operation period (or accumulated number of print-outs) as a thickness detector to indirectly detect the thickness of the charge transport layer 11*a* of the photoconductor drum 11. Such a thickness detector is useful when the thickness of the charge transport layer 11*a* of the photoconductor drum 11 decreases in proportional to the accumulated operation period (or accumulated number of prints).

It is noted that the power supply section 35 or the DC power supply 35*a* is controlled to increase the variation of the correction amount α relative to the variation of the reference voltage VC, when the transfer bias to be applied to the primary transfer roller 14 is great compared to a case in which the transfer bias to be applied to the primary transfer roller 14 is small.

Such control is performed because the electrical potential remaining on the photoconductor drum 11 is different due to the transfer condition in the first transfer process. Specifically, when the transfer bias is great, the electrical potential remaining on the photoconductor drum 11 increases, so that, even though a discharging process is performed by the discharging lamp 16, the target charged potential is not obtained in the charging process and the difference from the reference voltage VC increases.

In the present embodiment, variation of the correction amount α relative to variation of the reference voltage VC is varied, so that, even though the transfer condition drastically changes, the target charged potential VD can be generated on the photoconductor drum 11.

Finally, a control flow of the voltage application control or correction control of the charging voltage is summarized.

First, when the warming-up operation is performed upon power-on, image forming conditions are detected, so that a target charged potential VD (that equals to the reference voltage VC) is determined. The controller 30 obtains a thickness of the charge transport layer 11*a* of the photoconductor drum 11 based on the AC charging voltage applied from the AC power supply 35*b* and the electrical current value detected by the electric current sensor 36. Then, the controller 30 calculates and obtains the correction amount α based on the determined reference voltage VC (that equals to the target charged potential VD) and the thickness of the charge transport layer 11*a* by applying the formula stored in the memory. Further, the correction amount α is again corrected, if necessary, based on the value of the primary transfer bias. Thus, the finally determined correction amount α added to the reference voltage VC is set as the DC charging voltage, which is applied to the charging roller 12*a* from the DC power supply 35*a*. The AC power supply 35*b* applies the AC charging voltage to the charging roller 12*a* and a normal image forming process or the charging process is performed.

As described above, according to the present embodiment, the power supply section 35 or the DC power supply 35*a* is controlled to apply the DC charging voltage of reference voltage VC to which is added a correction amount α to the charging roller 12*a*, so that the charged potential VD of the surface of the photoconductor drum 11 assumes a target value, that almost corresponds to the reference voltage VC. The power supply section 35 or the DC power supply 35*a* is controlled to increase an absolute value of the correction amount α to be added to the reference voltage VC when the absolute value of the reference voltage VC that corresponds to the charged potential VD is smaller compared to a case in which the absolute value of the reference voltage VC is greater. With this structure, when the charging voltage to be applied from the power supply section 35 to the charging roller 12*a* is corrected, the charged potential formed on the surface of the photoconductor drum 11 constantly stably coincides with the target value.

In the present embodiment, constituent members of the image forming section including the photoconductor drum 11, the charging device 12, the developing device 13, and the cleaning device 15 are united together to form each process cartridge 10Y, 10M, 10C, or 10BK, thereby making the image forming section compact and improving the maintenance work. Alternatively, the charging device 12 may be excluded from the process cartridge and can be formed as a unit detachably attachable to the image forming apparatus 1.

In the description of the present embodiment, "process cartridge" means a unit including at least one among the charging device to charge the image carrier, the developing device to develop the latent image formed on the image carrier, and the cleaning device to clean the surface of the image carrier; and the image carrier. Such a unit is integrally formed and is detachably attachable to the image forming apparatus.

In addition, the present invention is applied to the image forming apparatus 1 in which the toner image formed on the surface of the photoconductor drum 11 by contacting the photoconductor drum 11 serving as an image carrier is transferred to the intermediate transfer belt 17 as an intermediate transfer body via the primary transfer roller 14; however, the present invention is not limited to such an image forming apparatus and can be applied to, for example, a monochrome image forming apparatus in which the toner image formed on the surface of the photoconductor drum while contacting the photoconductor drum as an image carrier, is transferred to the recording medium via the transfer roller.

Even in such a case, the same effect as that of the above-described embodiment of the present invention can be obtained.

The present invention is not limited to the above-described embodiments, and the configuration of the present embodiment can be appropriately modified other than suggested in each of the above embodiments within a scope of the technological concept of the present invention.

In addition, the number, position, shape, and the like of the parts and components are not limited to the above-described embodiments, and can be otherwise changed to the number, position, shape, and the like, suitable for implementing the present invention.

Additional modifications and variations of the present invention are possible in light of the above teachings. It is therefore to be understood that, within the scope of the appended claims, the invention may be practiced other than as specifically described herein.

What is claimed is:

1. An image forming apparatus, comprising:

an image carrier;

a power supply;

a charging member, to which the power supply applies a direct current (DC) charging voltage, to charge a surface of the image carrier; and a controller that causes the power supply to:

apply to the charging member the DC charging voltage of a sum of a reference voltage VC and a correction amount α, so that as charged potential VD of the surface of the image carrier assumes a target value that is substantially equal to the reference voltage VC; and increase an absolute value of the correction amount α to be added to the reference voltage VC in inverse proportion to an absolute value of the reference voltage VC, when the absolute value of the reference voltage VC is smaller compared to a case in which the absolute value of the reference voltage VC is greater.

2. The image forming apparatus as claimed in claim 1, wherein the image carrier comprises a photoconductive layer that includes a charge transport layer as a surface layer and a charge generation layer beneath the surface layer.

3. The image forming apparatus as claimed in claim 2, wherein the charge transport layer has an initial thickness of 30 μm or more.

4. The image forming apparatus as claimed in claim 3, wherein, as the thickness of the charge transport layer decreases over time, the controller causes the power supply to decrease variation of the correction amount α relative to variation of the reference voltage VC.

5. The image forming apparatus as claimed in claim 2, further comprising a thickness detector to directly or indirectly detect a thickness of the charge transport layer of the image carrier, wherein the power supply varies the correction amount α based on a detection result obtained by the thickness detector.

6. The image forming apparatus as claimed in claim 5, wherein the power supply applies to the charging member a superimposed charging bias in which an alternate current charging voltage is superimposed on the DC charging voltage; and the thickness detector detects a charging electrical current flowing to the charging member, and obtains the thickness of the charge transport layer based on the detected charging electrical current and the alternate current charging voltage applied from the power supply.

7. The image forming apparatus as claimed in claim 1, further comprising a transfer roller to transfer a toner image formed on the surface of the image carrier to an intermediate transfer body or to a recording medium while contacting the surface of the image carrier, wherein the charging member is a charging roller to contact the surface of the image carrier and the power supply applies to the charging roller a superimposed charging bias in which an alternate current charging voltage is superimposed on the DC charging voltage.

8. The image forming apparatus as claimed in claim 7, wherein the controller causes the power supply to increase variation of the correction amount $\alpha$ relative to variation of the reference voltage VC in direct proportion to a size of a transfer bias to be applied to the transfer roller, when the transfer bias to be applied to the transfer roller is great compared to a case in which the transfer bias to be applied to the transfer roller is small.

* * * * *